US008989634B2

(12) United States Patent
Tamaki et al.

(10) Patent No.: US 8,989,634 B2
(45) Date of Patent: Mar. 24, 2015

(54) DEVELOPER CASE THAT SUPPRESSES CLOGGING DUE TO DEVELOPER, DEVELOPER REPLENISHMENT UNIT HAVING THE SAME, AND IMAGE FORMING APPARATUS HAVING THE SAME

(71) Applicant: Kyocera Document Solutions Inc., Osaka (JP)

(72) Inventors: Kenichi Tamaki, Osaka (JP); Takahisa Nakaue, Osaka (JP); Tamotsu Shimizu, Osaka (JP); Ikuo Makie, Osaka (JP); Eiji Nimura, Osaka (JP); Koji Kuramashi, Osaka (JP); Masaki Hayashi, Osaka (JP); Yoshihiro Yamagishi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 238 days.

(21) Appl. No.: 13/630,718

(22) Filed: Sep. 28, 2012

(65) Prior Publication Data

US 2013/0084107 A1 Apr. 4, 2013

(30) Foreign Application Priority Data

Sep. 30, 2011 (JP) ..... 2011-217171

(51) Int. Cl.
*G03G 15/08* (2006.01)

(52) U.S. Cl.
CPC ..... *G03G 15/0891* (2013.01); *G03G 15/0877* (2013.01)
USPC ..... 399/258

(58) Field of Classification Search
CPC ..... G03G 15/0865; G03G 15/0875; G03G 15/0877
USPC ..... 399/258, 260, 262, 263
See application file for complete search history.

(56) References Cited

U.S. PATENT DOCUMENTS

| | | | | |
|---|---|---|---|---|
| 4,435,065 | A * | 3/1984 | Wada | 399/260 |
| 5,166,732 | A * | 11/1992 | Fuji | 399/61 |
| 2001/0046395 | A1 * | 11/2001 | Ashikari et al. | 399/262 |
| 2005/0281589 | A1 * | 12/2005 | Sakai et al. | 399/254 |

FOREIGN PATENT DOCUMENTS

| | | |
|---|---|---|
| JP | 2000-315007 | 11/2000 |
| JP | 2003-345118 | 12/2003 |
| JP | 2004-151341 | 5/2004 |
| JP | 2010-020227 | 1/2010 |

* cited by examiner

*Primary Examiner* — David Gray
*Assistant Examiner* — Thomas Giampaolo, II
(74) *Attorney, Agent, or Firm* — K&L Gates LLP

(57) ABSTRACT

A developer case includes a main body, a first transportation portion, a first transportation member, a supply member, a discharge port, and a second transportation portion. The main body contains developer. The first transportation portion has a first region that receives developer from the main body and a second region that extends from the first region in a first direction. The first transportation member transports developer in the first direction. The supply member supplies developer to the first region. Developer is discharged through the discharge port. The second transportation portion has an inlet port communicating with the second region. Developer that has not been discharged through the discharge port is supplied to the second transportation portion through the inlet port. The second transportation portion transports developer in a second direction.

16 Claims, 9 Drawing Sheets

DEVELOPER CASE THAT SUPPRESSES CLOGGING DUE TO DEVELOPER, DEVELOPER REPLENISHMENT UNIT HAVING THE SAME, AND IMAGE FORMING APPARATUS HAVING THE SAME

INCORPORATION BY REFERENCE

This application is based upon and claims the benefit of priority from the corresponding Japanese Patent application No. 2011-217171, filed Sep. 30, 2011, the entire contents of which is incorporated herein by reference.

BACKGROUND

The present disclosure relates to a developer case that replenishes a developer, such as toner, and the developer replenishment unit and an image forming apparatus equipped with same.

Presently, image forming apparatuses such as printers use a developer replenishment unit that includes a developing device and a toner container (developer case) positioned above the developing device. Toner is supplied to the developing device from a toner supply unit provided in the toner container.

When the toner container is located above the developing device, the developer replenishment unit is dimensioned so that its height corresponds to the developing device and the toner container. As a result, the space occupied by the image forming apparatus in the vertical direction is increased.

In order to reduce the space occupied by the image forming apparatus in the vertical direction as much as possible, a structure in which the toner container and the developing device are arranged in a substantially horizontal direction may be used. However, when the toner container is located at such a position, the developing device is not replenished with the toner from the toner container due to the natural dropping of the toner. That is, it is necessary to provide a transportation path in the horizontal direction from the toner container to the developing device. In this situation, the horizontal transportation path is provided above the toner container and the developing device. Thus, a supply member that scoops up the toner contained in the toner container is needed.

However, since the toner is transported upwardly against gravity, with such a structure, transportation efficiency tends to decrease. In order to compensate for the decrease in transportation efficiency of the supply member, transportation performance in the horizontal transportation path, through which the toner having been transported upward is transported, may be increased. However in such a case, the toner tends to clog the horizontal transportation path on the downstream side. To this end, clogging due to the toner is particularly likely to occur near a discharge port, through which the toner drops into the developing device, so as to replenish the developing device with the toner. This is due to the fluidity of the toner degrading by an amount corresponding to the amount of the toner required to be replenished and the amount of the developer existing in the developing device.

SUMMARY

A developer case according to an embodiment of the present disclosure is provided that includes a main body, a first transportation portion, a first transportation member, a supply member, a discharge port, and a second transportation portion. The main body has a bottom wall and contains developer. The first transportation portion has a first region and a second region. The first region is located above the bottom wall of the main body and receives the developer from the main body. The second region extends from the first region so as to project further in a first direction than the main body does. The first transportation member is located in the first transportation portion and transports the developer in the first direction. The supply member is located in the main body and supplies the developer to the first region of the first transportation portion. The discharge port is located in the second region of the first transportation portion. The developer is discharged through the discharge port. The second transportation portion has an inlet port communicating with the second region of the first transportation portion. The developer that has not been discharged through the discharge port is supplied to the second transportation portion through the inlet port. The second transportation portion transports the developer in a second direction.

A developer replenishment unit according to another embodiment of the present disclosure is provided that includes a developing device, and the above-described developer case. The developing device has a housing, a developer transportation path set in the housing, and a receiving port that is located at a position opposite a discharge port of the housing and allows the developer that is discharged through the discharge port to pass therethrough so that the housing receives the developer.

An image forming apparatus according to another embodiment of the present disclosure is provided that includes an image carrying body, the above-described developing device, and the above-described developer case. An electrostatic latent image is formed on the image carrying body and the image carrying body carries a developer image formed by visualizing the electrostatic latent image using developer.

Additional features and advantages are described herein, and will be apparent from the following Detailed Description and the figures.

DETAILED DESCRIPTION

Figure 1:
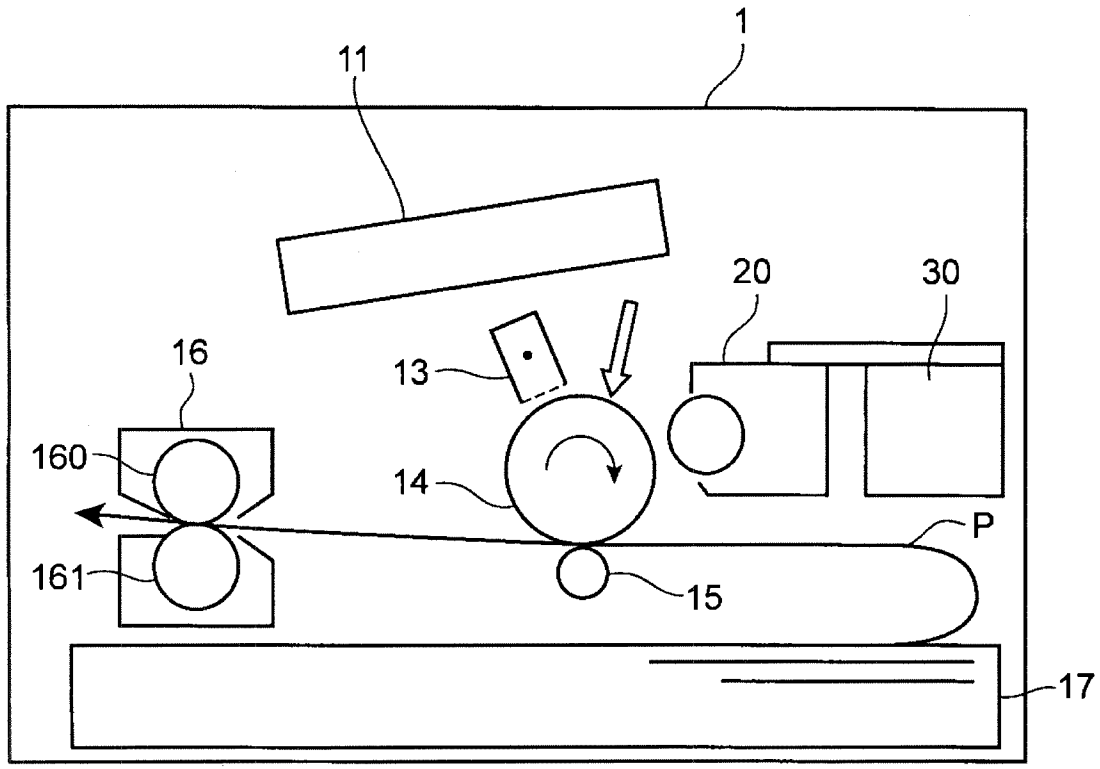
FIG. 1 is a sectional view illustrating an internal structure of an image forming apparatus according to an embodiment of the present disclosure.

A toner container 30 (developer case) according to an embodiment of the present disclosure will be described below with reference to the drawings. FIG. 1 is a sectional view schematically illustrating the structure of an image forming apparatus 1 including the toner container 30 according to the embodiment of the present disclosure. The image forming apparatus 1 includes an optical scanning device 11, a developing device 20, a charger 13, a photoconductor drum 14 (image carrying body), a transfer roller 15, a fixing device 16, and a sheet feed cassette 17. In some cases, the developer case is included in the developing device. The unit combined the developer case and the developing device is called a developer replenishment unit.

The photoconductor drum 14 is a cylindrical member. An electrostatic latent image and a toner image are formed on a circumferential surface of the photoconductor drum 14. The photoconductor drum 14 receives a drive force from a motor (not shown), thereby being rotated in a direction that is the clockwise direction in FIG. 1. The charger 13 substantially uniformly charges the surface of the photoconductor drum 14.

The optical scanning device 11 includes a light source, a deflector, a scanning lens, and an optical element, and so forth. The light source uses a laser diode or the like. The optical scanning device 11 radiates a laser beam in accordance with image data toward the circumferential surface (scanned surface) of the photoconductor drum 14, which is substantially uniformly charged by the charger 13, so as to form an electrostatic latent image of the image data.

The developing device 20 supplies toner to the circumferential surface of the photoconductor drum 14, on which the electrostatic latent image has been formed, thereby forming a toner image. The developing device 20 includes components such as a developing roller, which carries the toner, and screws, which agitate and transport the toner. The toner image formed on the photoconductor drum 14 is transferred to a recording sheet picked up from the sheet feed cassette 17 and transported through a transportation path P. The developing device 20 is replenished with the toner from the toner container 30. The developing device 20 and the toner container 30 will be described in detail hereinafter.

The transfer roller 15 is positioned below the photoconductor drum 14 so as to face the photoconductor drum 14, thereby forming a transfer nip therebetween. The transfer roller 15 is formed of an electrically conductive rubber material or the like. A transfer bias is applied to the transfer roller 15 by a bias application unit (not shown). The transfer roller 15 causes the toner image formed on the photoconductor drum 14 to be transferred to the recording sheet.

The fixing device 16 includes a fixing roller 160, which includes a heater therein, and a pressure roller 161 located at a position opposite the fixing roller 160. The fixing device 16 causes the toner image formed on the recording sheet to be fixed to the recording sheet through heating performed while the recording sheet on which the toner image is formed is being transported.

Description of Developing Device

Figure 2:
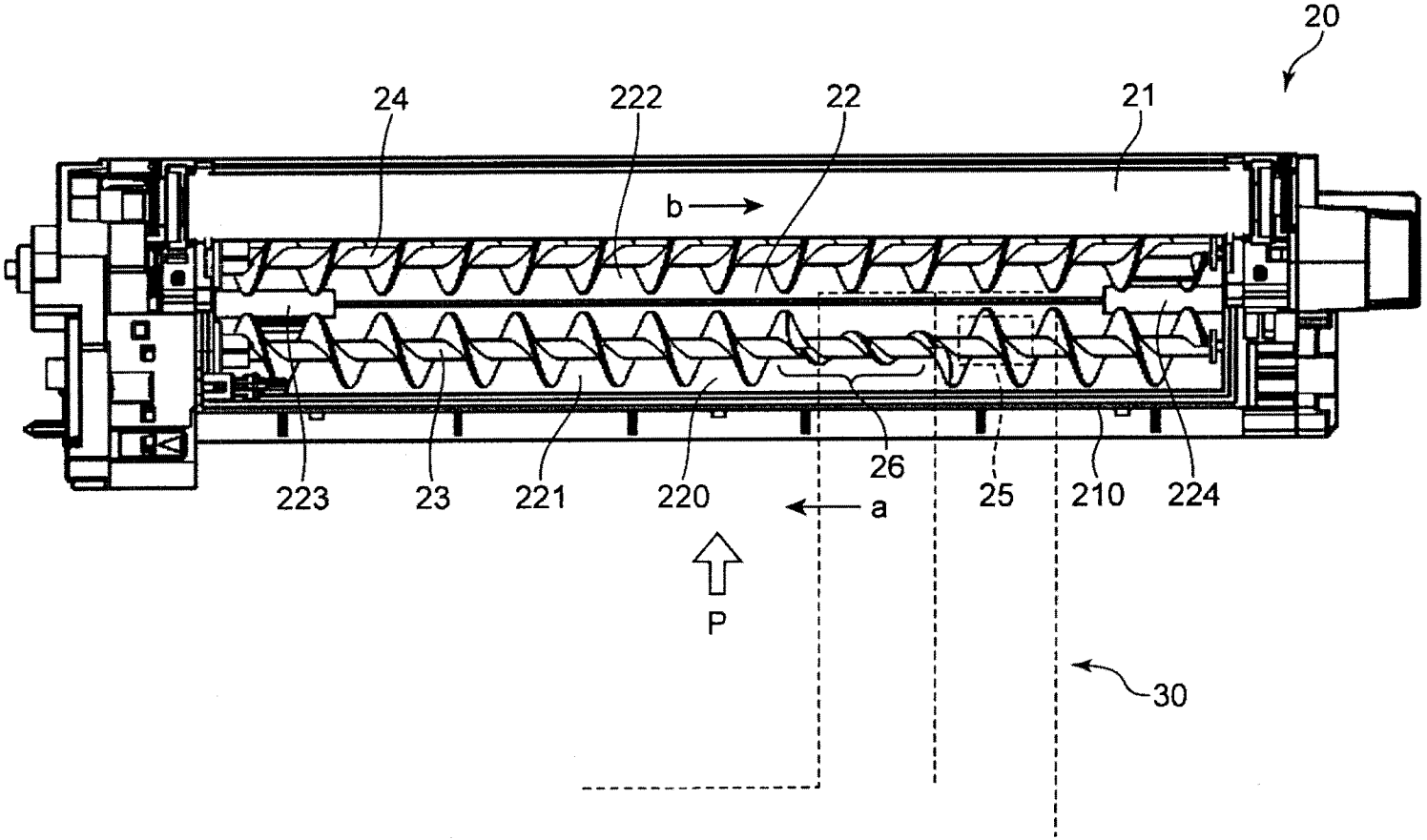
FIG. 2 is a plan view illustrating a developing device according to the embodiment of the present disclosure.

FIG. 2 is a plan view of an internal structure of the developing device 20. The developing device 20 includes a developing housing 210 (housing). The developing housing 210 has a box shape elongated in a single direction (axial direction of a developing roller 21). An internal space 220 is formed in the developing housing 210. The developing roller 21, a first transportation screw 23 and a second transportation screw 24 are positioned parallel to one another in the internal space 220. When a one-component development method is used, the internal space 220 is filled with toner that is used as a developer. When a two-component development method is used, the internal space 220 is filled with a mixture of carrier formed of a magnetic material and toner, the mixture serving as the developer.

In the internal space 220, toner is transported while being agitated, successively supplied to the developing roller 21, and consumed so as to develop the electrostatic latent image. The toner for replenishment is supplied as appropriate in an amount corresponding to the consumed amount from the toner container 30 (developer case), which will be described hereinafter. The developing roller 21 has a cylindrical shape that extends in the elongated direction of the developing housing 210 and has a sleeve portion, which is rotated, on an outer circumference thereof. When a one-component developing method is used, the toner having been charged by frictional electrification is attracted to the sleeve portion from the second transportation screw 24. When a two-component developing method is used, the carrier as a magnetic material together with the toner, which is attracted to the carrier by electrostatic force, are attracted from the second transportation screw 24 to a surface of the sleeve portion by an electric field formed by a magnetic pole fixed inside the sleeve portion. The toner (developer) carried on the surface of the sleeve portion is transported to an opening (not shown) formed in the developing housing 210 so as to be supplied to the photoconductor drum 14 opposite the sleeve portion.

The internal space 220 of the developing housing 210 is separated into a first path 221 and a second path 222, which are both elongated in a left-right direction (axial direction), by a separator plate 22, which extends in the left-right direction. The separator plate 22 is shorter than the width of the developing housing 210 in the left-right direction. An upstream communication path 223 and a downstream communication path 224 are respectively formed at the right and left ends of the separator plate 22. The upstream communication path 223 and the downstream communication path 224 allow the first path 221 and the second path 222 to communicate with each other. Thus, the developing housing 210 has a circulation path (developer transportation path) formed therein from the first path 221, the upstream communication path 223, the second path 222, to the downstream communication path 224.

The first path 221 contains the first transportation screw 23, and the second path 222 contains the second transportation screw 24. The first transportation screw 23 (third transportation member) and the second transportation screw 24 include respective rotation shafts and respective agitating blades protruding from the peripheries of the rotation shafts in a spiral shape. The first transportation screw 23 is rotated about its rotation shaft, thereby transporting the toner in a direction indicated by arrow a in FIG. 2. The second transportation screw 24 is rotated about its rotation shaft, thereby transporting the toner in a direction indicated by arrow b in FIG. 2. Rotation of the first and second transportation screws 23 and 24 causes the toner to be transported in a circulating manner through the above-described circulation path.

The first transportation screw 23 and the second transportation screw 24 of the developing device 20 are covered with a top plate (not shown). The developing device 20 has a toner replenishment port 25 (receiving port), through which the developing device 20 is replenished with the toner. The toner replenishment port 25 is defined by an opening (indicated by a dotted box in FIG. 2) formed in the top plate at an upper position near a right end of the first path 221. The toner container 30 is located above the toner replenishment port 25. The toner container 30 has a toner transportation path formed therein. The toner container 30 is combined with the developing device 20 such that the lengthwise direction of the toner container 30 (direction in which the toner transportation path extends) is perpendicular to the lengthwise direction of the developing device 20 (direction in which the developer is transported by the first transportation screw 23). The developing device 20 is replenished with toner that drops down from the toner container 30 through the toner replenishment port 25.

Description of Developer Accumulation Portion

Figure 3:
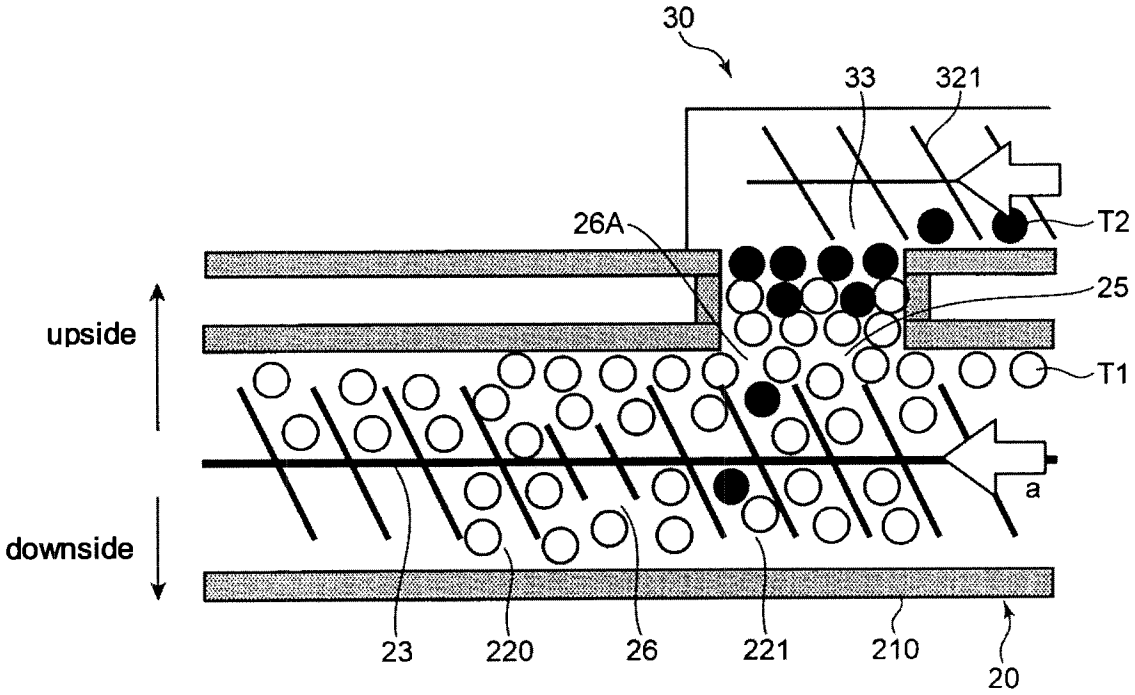
FIG. 3 illustrates a toner replenishment portion of the developing device according to the embodiment of the present disclosure.

Next, the flow of the toner, with which the developing device 20 is newly replenished through the toner replenishment port 25, will be described. FIG. 3 is a schematic diagram illustrating the toner replenishment port 25, a toner discharge port 33, and an area around them. The toner replenishment port 25 is formed in the developing device 20, and the toner discharge port 33 is formed in the toner container 30, which will be described later. For convenience of description, in FIG. 3, the arrangement of the toner container 30 is rotated by 90 degrees in the horizontal direction. In the actual toner container 30, a first transportation member 321 extends toward the front side of the page of FIG. 3, and the first transportation screw 23 and the first transportation member 321 in the toner container 30 are perpendicular to each other.

Toner T2 supplied through the toner discharge port 33 of the toner container 30 drops into the first path 221, and is mixed with existing toner T1. The mixture of the toner T2 and T1 is then transported in a direction indicated by arrow a by the first transportation screw 23. In so doing, the toner is agitated and charged.

Here, the first transportation screw 23 has a transportation capacity reducing portion 26 on the downstream side of the toner replenishment port 25 in the toner transportation direction. The transportation capacity reducing portion 26 is formed by omitting part of an agitating blade of the first transportation screw 23. In the first transportation screw 23, the amount of toner to be transported by this blade-omitted portion is decreased compared to other portions that do not have the blade-omitted portion. Because of this, the toner transported through the first path 221 accumulates on the upstream side of the transportation capacity reducing portion 26 in the transportation direction.

In an embodiment, the transportation capacity reducing portion 26 is defined by the portion of the first transportation screw 23 where part of the agitating blade is omitted. Alternatively, the first transportation screw 23 may include a bar member positioned parallel to the rotation shaft thereof at a periphery of the agitating blade of thereof, and the transportation capacity reducing portion 26 may be defined by a portion of the first transportation screw where the bar member is located. Because the bar member is attached to the agitating blade, toner transportation capacity can be reduced, and accordingly, the toner can accumulate.

With the transportation capacity reducing portion 26, the toner transported in the direction indicated by arrow a through the first path 221 accumulates at a position immediately upstream of the transportation capacity reducing portion 26 and opposite the toner replenishment port 25. Thus, an accumulation portion 26A (developer accumulation portion) is formed. Accordingly, when the amount of the toner in the developing housing 210 is increased due to replenishment of the toner through the toner replenishment port 25, the toner accumulated in the accumulation portion 26A blocks the toner replenishment port 25, thereby suppressing further replenishment of the toner. After that, when the amount of the toner having accumulated in the accumulation portion 26A decreases due to consumption of the toner in the developing housing 210, the amount of the toner that blocks the toner replenishment port 25 decreases. This causes the toner to move into the developing housing 210 again through the toner discharge port 33.

When the toner is then forcibly discharged through the toner discharge port 33 of the toner container 30, while the toner replenishment port 25 is being blocked by the toner in the accumulation portion 26A, toner is compressed and a toner block is formed. Once the toner block is formed near the toner discharge port 33 and the toner replenishment port 25, toner replenishment is then prevented, and accordingly, the amount of the toner in the developing housing 210 gradually decreases. As a result, toner image formation on the photoconductor drum 14 is unsatisfactorily performed, leading to image fading or the like.

Description of Toner Container

Figure 4:
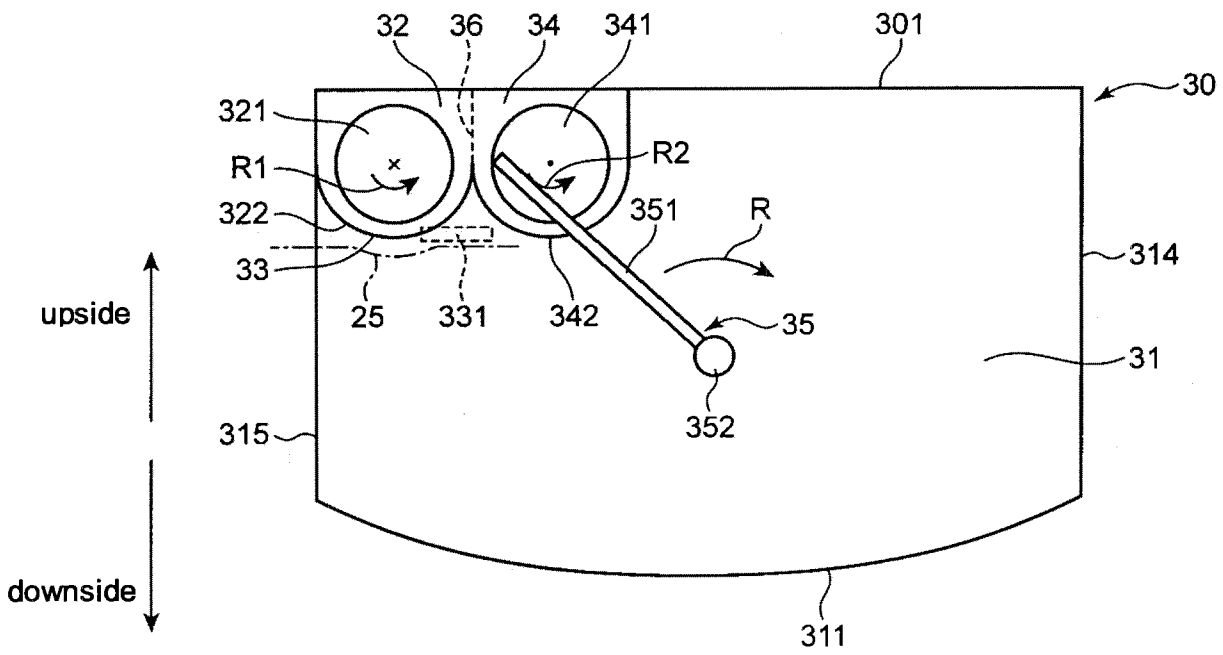
FIG. 4 is a side view of a toner container of an embodiment of the present disclosure.
Figure 5:
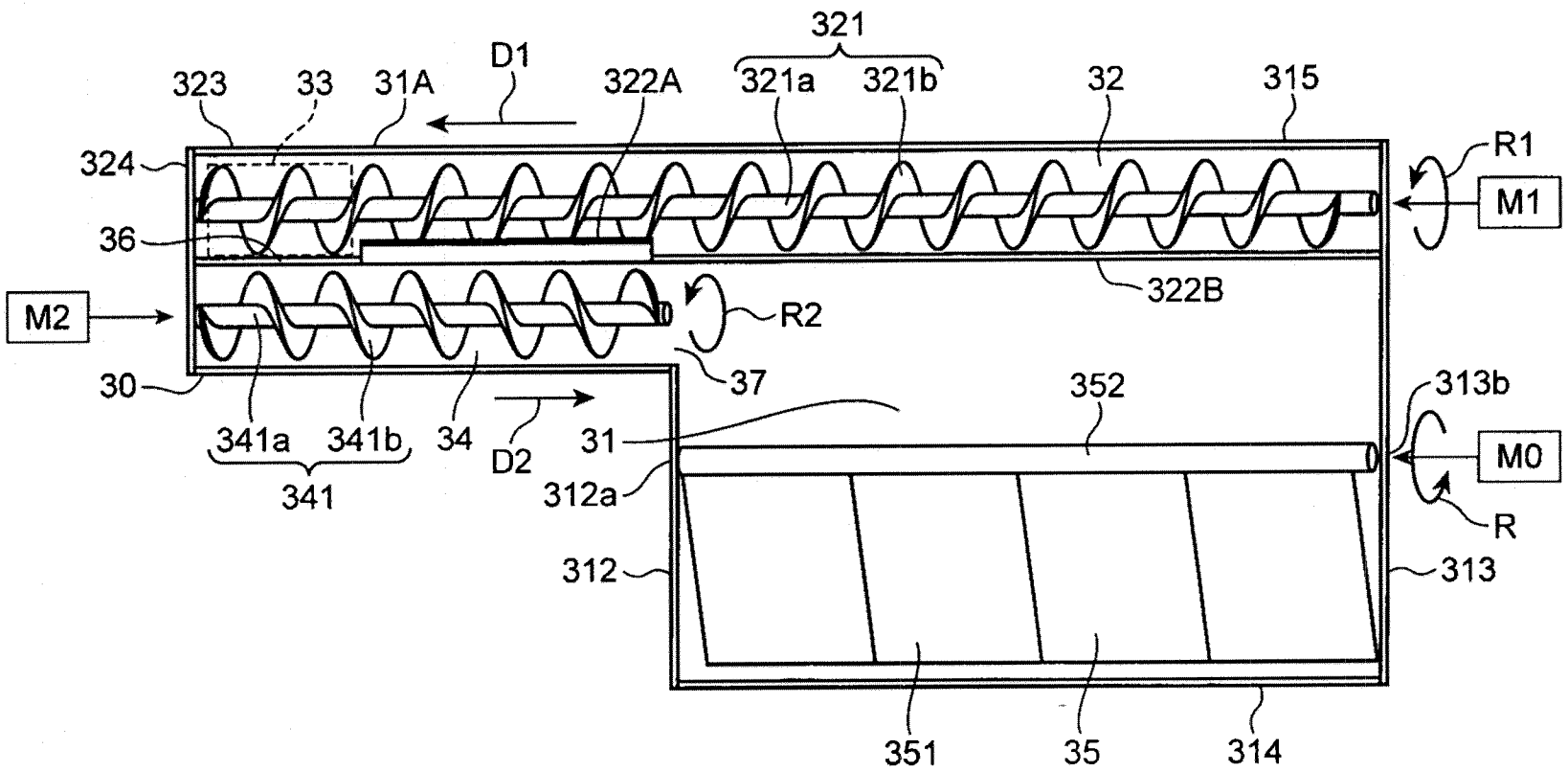
FIG. 5 is a plan view of the toner container of the embodiment of the present disclosure illustrated in FIG. 4.
Figure 6:
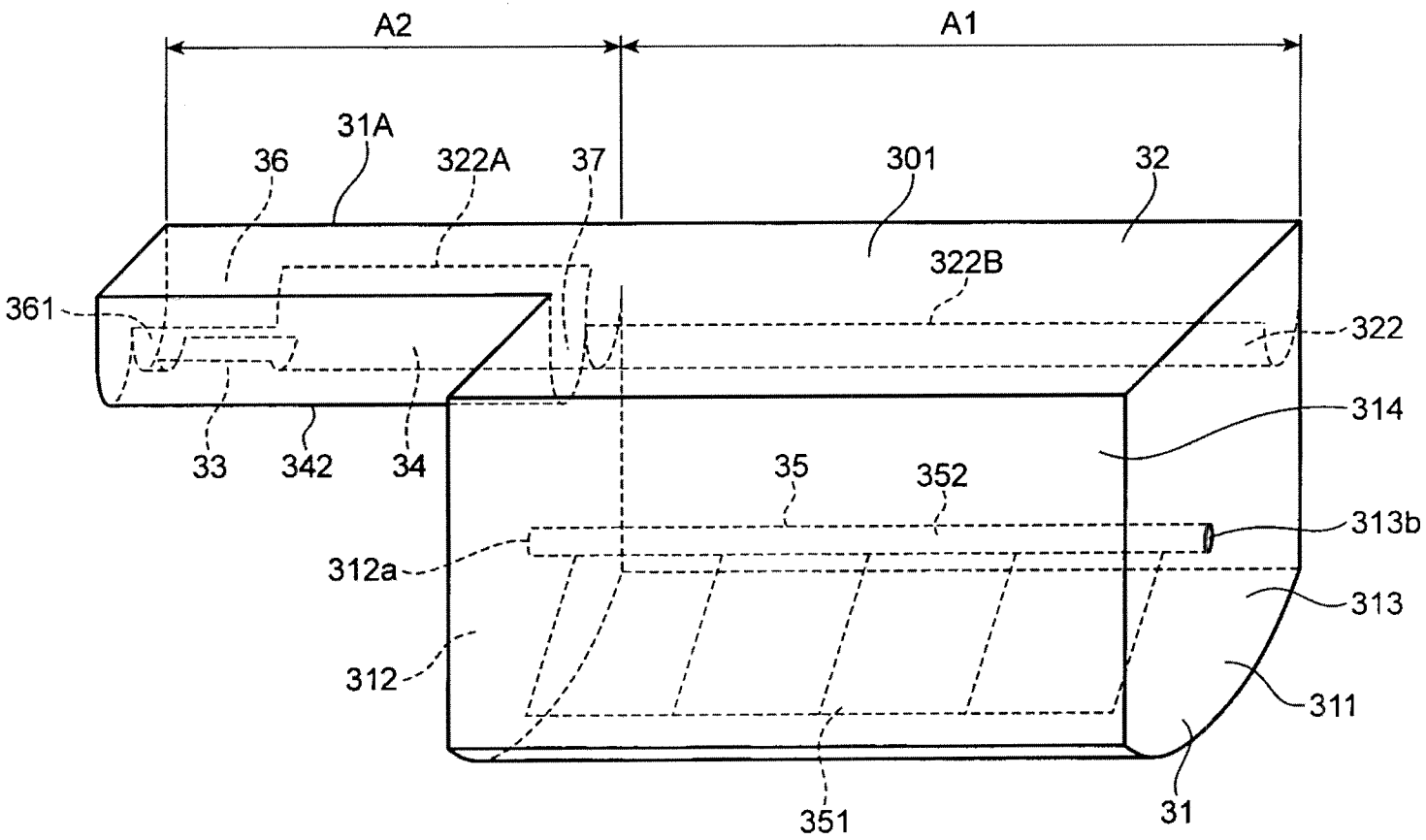
FIG. 6 is a perspective view of the toner container of the embodiment of the present disclosure illustrated in FIG. 4.

Next, the structure and function of the toner container 30 according to an embodiment will be described. FIG. 4 is a side sectional view of the toner container 30 according to an embodiment of the present disclosure. FIG. 5 is a plan view of the toner container 30 with a top plate 301 removed. The top plate 301 will be described hereinafter. FIG. 6 is a perspective view illustrating the positional relationship inside the toner container 30.

The toner container 30 includes a toner containing portion 31 (main body) and a projection portion 31A. The toner containing portion 31 contains the toner. The projection portion 31A has the toner discharge port 33, through which the toner is supplied to the developing device 20. The toner container 30 also has a first transportation portion 32 and a second transportation portion 34. The first transportation portion 32 receives the toner from the toner containing portion 31 and transports the toner to the toner discharge port 33. The second transportation portion 34 returns part of the toner that is not discharged through the toner discharge port 33 to the toner containing portion 31.

The toner containing portion 31 has a container bottom wall 311 (bottom wall), side wall portions 312 and 313, a front wall portion 314, and a rear wall portion 315. The container bottom wall 311 has a substantially arc shape in sectional view and extends in a first direction. The side wall portions 312 and 313 extend vertically upwardly from both sides of the container bottom wall 311. The front wall portion 314 extends vertically upwardly from a front surface of the container bottom wall 311. The rear wall portion 315 extends vertically upwardly from the rear surface of the container bottom wall 311. The upper part of the toner containing portion 31 is closed by the top plate 301, which is connected to the side wall portions 312 and 313, the front wall portion 314, and the rear wall portion 315. The toner (developer) is contained in this closed space.

A rotating paddle 35 (supply member) is located in the toner containing portion 31 such that the rotating paddle 35 is rotatably supported by the toner containing portion 31. Specifically, the rotating paddle 35 has a shaft portion 352, which is rotatably supported by shaft support portions 312*a* and 313*b* respectively, formed on the side wall portions 312 and 313. The rotating paddle 35 is located on the shaft portion 352 and has a paddle portion 351 that agitates and transports the toner in the toner containing portion 31. The paddle portion 351 is formed of four plate-shaped members, which are positioned in the axial direction of the shaft portion 352 so as to be adjacent to one another. The rotating paddle 35 is rotated in a direction indicated by arrow R in FIG. 5, by a motor M0 positioned externally to the toner container 30.

The first transportation portion 32 is located above the container bottom wall 311 of the toner containing portion 31 along the rear wall portion 315. The first transportation portion 32 is parallel to the shaft portion 352 of the rotating paddle 35. The first transportation portion 32 has a semi-cylindrical shape in sectional view, an upper surface side of which opens and a lower surface side of which has a semi-circular shape. The first transportation portion 32 extends in the horizontal direction. The semi-circular lower surface is formed of a first transportation bottom wall 322 formed of a curved surface having a semi-circular section. The first transportation portion 32 has an opening portion 322B on a side surface thereof opposite the toner containing portion 31 in the axial direction of the rotating paddle 35 so as to communicate with the toner containing portion 31. The region of the first transportation portion 32 opposite the toner containing portion 31 is defined as a first region A1 (FIG. 6). The toner contained in the toner containing portion 31 is scooped upward as the rotating paddle 35 rotates, thereby being delivered to the first region A1 through the opening.

In addition to the first region A1 that opposes the toner containing portion 31, the first transportation portion 32 has a second region A2 (FIG. 6) having a cylindrical shape extending from the first region A1 in a first direction (a direction indicated by an arrow D1 in FIG. 5) so as to project further outward than does the toner containing portion 31. The first transportation member 321, which transports the toner received from the toner containing portion 31 in the first direction, is positioned in the first transportation portion 32 throughout the first region A1 and the second region A2. The first transportation member 321 has a shaft portion 321*a* and a blade portion 321*b* (spiral portion), which has a screw shape and is positioned on the shaft portion 321*a*. The first transportation member 321 is rotated in the direction indicated by arrow R1, by a motor M1 (first drive unit, see FIG. 5) positioned externally to the toner container 30, thereby transporting the toner received from the toner containing portion 31 in the first direction (direction indicated by the arrow D0.

The toner discharge port 33 is formed near the downstream end of the second region A2 in the lower surface of the first transportation bottom wall 322. The developer is discharged toward the developing device 20 through the toner discharge port 33. The toner transported by the first transportation member 321 through the first region A1 and the second region A2 reaches the toner discharge port 33. When the toner container 30 and the aforementioned developing device 20 are combined with each other, the toner replenishment port 25 formed in the developing housing 210 comes to a position below the toner discharge port 33 so as to oppose the toner discharge port 33. The toner having been transported to the toner discharge port 33 is discharged outside of the toner container 30 through the toner discharge port 33 whenever necessary and moves into the developing housing 210 through the toner replenishment port 25. In the situation where the toner container 30 is not combined with the developing device 20, the toner discharge port 33 is covered with a shutter 331, which is slidably positioned on the outside of the toner discharge port 33, so as to prevent toner from leaking.

In an embodiment, the toner container 30 and the developing device 20 are adjacent to each other in the horizontal direction as illustrated in FIG. 1. Thus the area where the toner container 30 and the developing device 20 are superposed on each other in the up-down direction is decreased, thereby reducing the space occupied by the whole image forming apparatus 1 in the up and down direction. In the situation where the developing device 20 needs to be replenished with the toner, in order to supply the toner through the toner discharge port 33 without delay, the inside of the second region A2 needs to be constantly filled with the toner. As has been previously described, the accumulation portion 26A is formed by the agitating blade of the first transportation screw 23 in the developing housing 210 of the developing device 20. Accordingly, the toner having been transported through the first transportation portion 32 of the toner container 30 cannot be discharged through the toner discharge port 33 in the situation where there is much toner accumulating in the accumulation portion 26A of the developing housing 210. In this situation, the toner is compressed, thereby forming a toner block.

In an embodiment, in order to prevent the toner from accumulating, or to prevent clogging due to the toner from occurring near the toner discharge port 33, the second transportation portion 34 is provided. The second transportation portion 34 has a semi-cylindrical shape in sectional view similar to that of the first transportation portion 32, an upper surface side of which opens and a lower surface side of which has a semi-circular shape. The second transportation portion 34 is positioned adjacent to and parallel to the second region A2 of the first transportation portion 32. The second transportation portion 34 has an inlet port (first communication portion 36), which is formed on the downstream side in the transportation direction (first direction) of the first transportation member 321 in the first transportation portion 32 at a position opposing the toner discharge port 33. The second transportation portion 34 communicates with the first transportation portion 32 through the inlet port.

Out of the toner having been transported by the first transportation member 321 through the first transportation portion 32, part of the toner not discharged from the toner discharge port 33 is blocked at a space formed by a side end wall 323 and an end wall 324 (FIG. 5), which form an end portion of the first transportation portion 32. This toner is caused to move into the second transportation portion 34 side through the first communication portion 36 by a transportation force applied thereto by the first transportation member 321.

A second transportation member 341, which transports toner in the second direction that is not discharged through the toner discharge port 33, is rotatably positioned in the second transportation portion 34. The second transportation member 341 has a shaft portion 341*a* and a blade portion 341*b*, which has a screw shape and is located on the shaft portion 341*a*. The shaft portion 341*a* and the blade portion 341*b* have diameters that are the same as those of the shaft portion 321*a* and the blade portion 321*b* of the first transportation member 321, respectively. The blade portion 321*b* of the first transportation member 321 and the blade portion 341*b* of the second transportation member 341 are respectively formed on the shaft portion 321*a* and the shaft portion 341*a* such that the pitch of turns of the blade portion 321*b* in its transportation direction is the same as that of the blade portion 341*b* in its transportation direction. Also in an embodiment, the number of rotations per unit time of the first transportation member 321 is the same as that of the second transportation member 341. The second transportation member 341 is rotated by a motor M2 (second drive unit), thereby transporting the toner received through the first communication portion 36 in a direction (second direction) opposite to the first direction (FIG. 5).

An end portion (outlet port) of the second transportation portion 34, the end portion being on the downstream side in the transportation direction of the second transportation member 341, is connected to the side wall portion 312 of the toner containing portion 31, and the second transportation portion 34 and the toner containing portion 31 are communicate with each other through a second communication portion 37. Thus, the toner received by the second transportation portion 34 through the first communication portion 36 is transported by the second transportation member 341, and then drops again into the toner containing portion 31 to be mixed with the toner in the toner containing portion 31.

As described above, in an embodiment, the excess toner, which is part of the toner that has been transported by the first transportation member 321 and then not discharged through the toner discharge port 33, is blocked by the side end wall 323 and the end wall 324 and moves into the second transportation portion 34 through the first communication portion 36. Thus, excessive compression of the toner does not occur, and accordingly, clogging due to the toner is unlikely to occur near the toner discharge port 33. Furthermore, the excess toner having moved into the second transportation portion 34 is transported in the second direction by the second transportation member 341 and moves into the toner containing portion 31 again. The excess toner in the toner containing portion 31 is transported in a circulating manner to the toner discharge port 33 through agitation and transportation performed by the rotating paddle 35 and the first transportation member 321. Thus, the excess toner can be reused and wastage of the toner can be suppressed.

In an embodiment, the first communication portion 36 is formed by cutting an upper end portion 322A of the first transportation bottom wall 322. Accordingly, a communication wall 361 having a specific height is formed under the first communication portion 36 (FIG. 6). With this structure, the toner having been transported by the first transportation member 321 does not easily move toward the second transportation portion 34 side, thereby ensuring the density of the toner around the toner discharge port 33.

Furthermore, in order to facilitate passage of the toner through the first communication portion 36, the rotation direction of the first transportation member 321 is set such that, in sectional view, an outer edge of the blade portion 321*b* of the first transportation member 321 moves toward the first communication portion 36 along the first transportation bottom wall 322. Likewise, the rotation direction of the second transportation member 341 is set such that, in sectional view, an outer edge of the blade portion 341*b* of the second transportation member 341 moves away from the first communication portion 36 along a second transportation bottom wall 342 (see arrows R1 and R2 in FIGS. 4 and 5).

Figure 7:
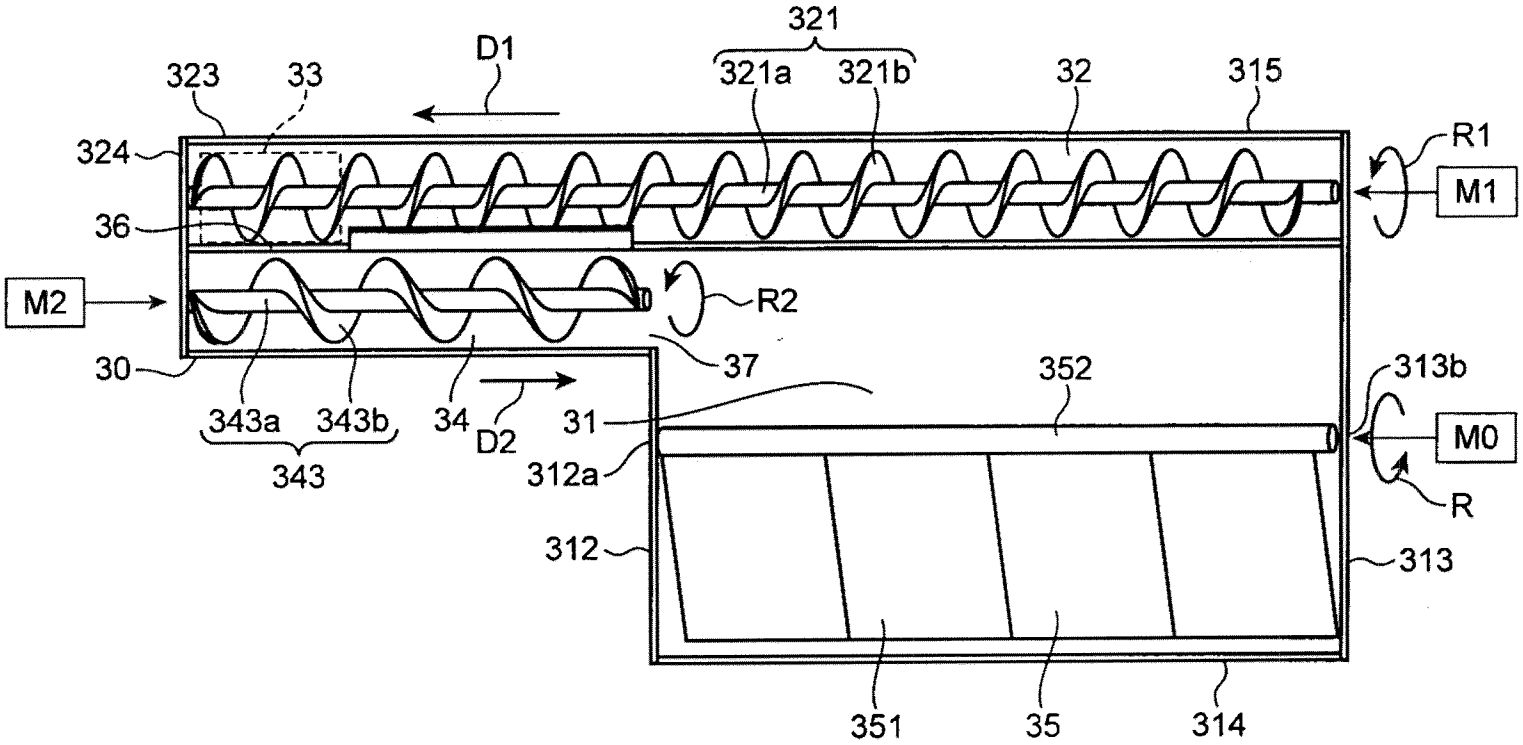
FIG. 7 is a plan view of a toner container of another embodiment of the present disclosure.

Next, the toner container 30 according to another embodiment of the present disclosure is described. FIG. 7 is a plan view of the toner container 30 according to an embodiment with the top plate 301 removed. The difference between this embodiment and the previous embodiment is that, in this embodiment, the shape of a second transportation member 343 is different from that of the first transportation member 321. Thus, this structure is described below and description of the other structures is omitted.

As is the situation with the first transportation member 321, the second transportation member 343 has a shaft portion 343*a* and a blade portion 343*b*. However, the pitch of turns of the blade portion 343*b* (spiral portion) is set to be larger than that of the blade portion 321*b* of the first transportation member 321. That is, the amount of the developer to be fed per rotation of the blade portion 343*b* is larger. As a result, compared to the first transportation member 321, the amount of the developer to be transported per unit time by the second transportation member 343 is larger.

With the above described structure, the excess toner overflowed near the toner discharge port 33 can be immediately transported in the second direction by the second transportation member 343 after the excess toner has been received by the second transportation portion 34 through the first communication portion 36. Thus, the developer does not accumulate near the first communication portion 36, and accordingly, clogging due to the developer near the toner discharge port 33 is further suppressed.

As described above, in this embodiment, the amount of the developer to be transported per unit time by the second transportation member 343 is set to be greater than that by the first transportation member 321, thereby further suppressing clogging due to the developer near the toner discharge port 33. Here, adjustment of the amount of the developer to be transported per unit time by the second transportation member 343 is not limited to a change in the pitch of the turns of the blade portion 343*b*. The same effect can also be obtained by, for example in FIG. 5, increasing the number of rotations of the second transportation member 341 while the pitch of the turns of the blade portion 341*b* of the second transportation member 341 and the pitch of the turns of the blade portion 321*b* of the first transportation member 321 are kept unchanged. Specifically in this situation, the motor M1 rotates the first transportation member 321 at a first number of rotations per unit time. The motor M2 rotates the second transportation member 341 at a second number of rotations, which is greater than the first number of rotations by a specified number of rotations.

Figure 8:
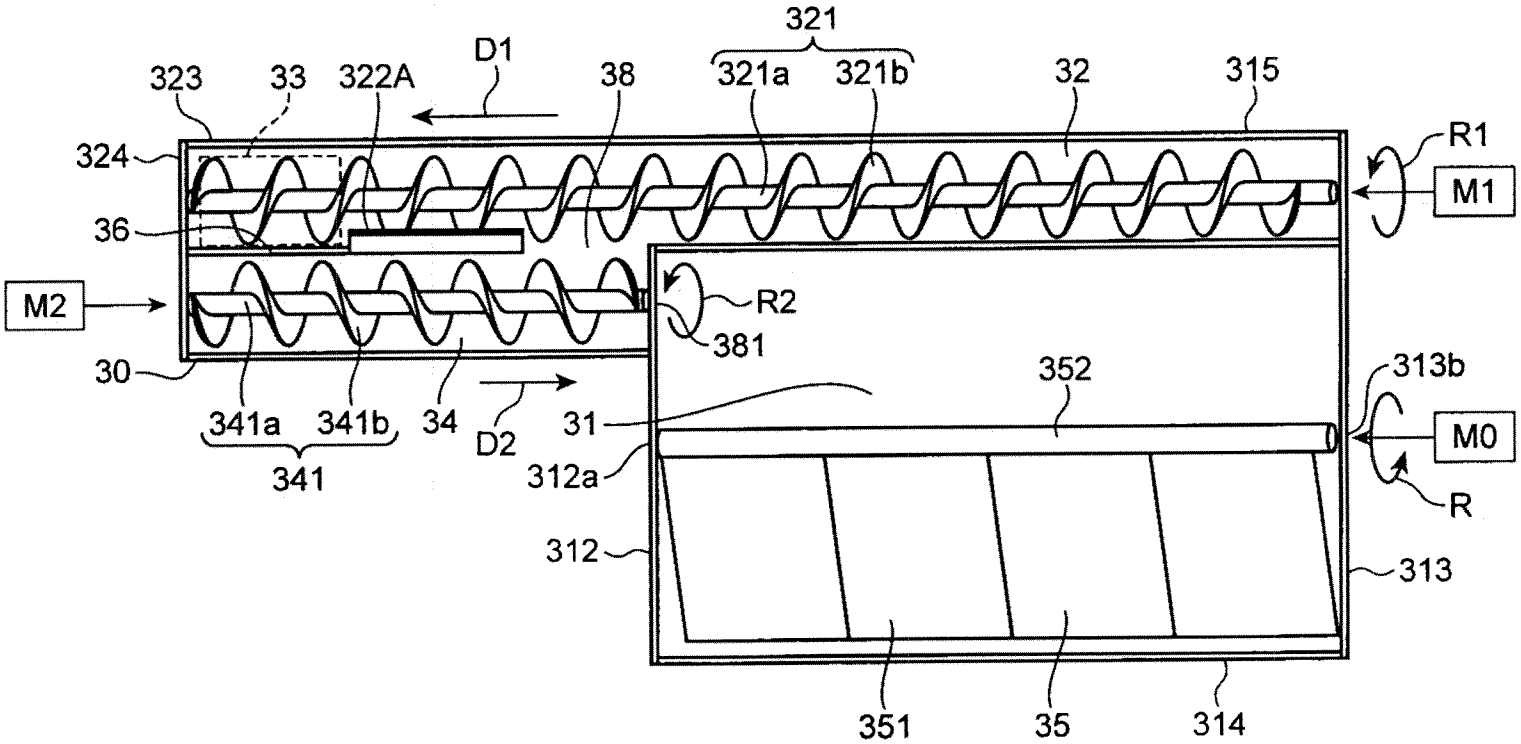
FIG. 8 is a plan view of a toner container of yet another embodiment of the present disclosure.

Next, the toner container 30 according to yet another embodiment of the present disclosure is described. FIG. 8 is a plan view of the toner container 30 according to this embodiment having the top plate 301 removed. The difference between this embodiment and the previous embodiment is that, in this embodiment, the outlet port of the second transportation portion 34 communicates with the first transportation portion 32 instead of communicating with the toner containing portion 31. Thus, this structure is described below and the description of the other structures is omitted.

The second transportation portion 34 is partitioned by a partition wall 381 downstream in the transportation direction of the second transportation member 341. In addition, part of the upper end portion 322A of the first transportation bottom wall 322, by which the first transportation portion 32 and the second transportation portion 34 are separated from each other, is cut so as to form an opening (outlet port). The opening defines a third communication portion 38, which communicates the second transportation portion 34 with the first transportation portion 32. The toner having been transported in the second direction through the second transportation portion 34 is blocked by the partition wall 381 and receives a transportation force applied thereto by the second transportation member 341, thereby moving into the first transportation portion 32 through the third communication portion 38. Then, the toner receives a transportation force applied thereto by the first transportation member 321 of the first transportation portion 32, thereby being transported again toward the toner discharge port 33.

As described above, using the toner container 30 of this embodiment, excessive compression of the toner does not occur, and accordingly, clogging due to the toner does not occur near the toner discharge port 33. Furthermore, the excess toner that moves into the second transportation portion 34 is transported in the second direction by the second transportation member 341, and then moves into the first transportation portion 32 through the third communication portion 38. As a result, excess toner can be reused through agitation and transportation performed by the first transportation member 321. Thus, waste of the toner can be suppressed.

In the developing device 20 including the toner container 30 according to any of the aforementioned embodiments, clogging due to the toner is unlikely to occur in a toner replenishment path. This suppresses the occurrence of a situation in which a toner block moves into the developing device. This can also prevent the following situation from occurring: the developing housing 210 not being replenished with the toner because of clogging due to the toner, and accordingly, the amount of the toner in the developing housing 210 is decreased.

In particular, clogging due to toner easily occurs with a structure in which the accumulation portion 26A is formed by the first transportation screw 23 at a position in the developing housing 210 opposite the toner replenishment port 25, and the developing housing 210 is replenished with the toner through the toner discharge port 33 as the amount of the developer in the accumulation portion 26A decreases. Even with such a structure, by using the toner container 30 according to any of the aforementioned embodiments, clogging due to the toner near the toner discharge port 33 and the toner replenishment port 25 can be suppressed.

Furthermore, with the toner container 30 according to any of the aforementioned embodiments and the image forming apparatus 1 including the developing device 20 equipped with the toner container 30 according to any of the aforementioned embodiments, the occurrence of image fading due to a decrease in the amount of the toner in the developing housing 210 is suppressed. Image flaws caused by a toner block entering the developing housing 210 can also be prevented from occurring.

Although the toner containers 30 according to the embodiments of the present disclosure have been described above, the present disclosure is not limited to these and the embodiment may be modified, for example, as follows.

(1) In the another embodiment, transportation performance of the second transportation member 341 in transporting the developer is set to be greater than that of the first transportation member 321, thereby further suppressing clogging due to the developer near the toner discharge port 33. In the aforementioned structures, the transportation performance of the second transportation member 341 in transporting the developer is adjusted by changing the pitch of the turns of the blade portion 341*b* or changing the number of rotations of the second transportation member 341. However, the methods of adjusting transportation performance are not limited to these. The relationship between the degree of transportation performance between the first transportation member 321 and the second transportation member 341 may be adjusted by making the first transportation member 321 and the second transportation member 341 of different shapes or the like.

(2) In the aforementioned embodiments, the second transportation member 341 is located in the second transportation portion 34. However, the structure is not limited to this. That is, the second transportation portion 34 may have a surface inclined from the first communication portion 36 toward the container bottom wall 311 of the toner containing portion 31. In this situation, excess toner is pushed out through the first communication portion 36 to the second transportation portion 34 only by a transportation force applied thereto by the first transportation member 321, and then slides on the inclined surface so as to be transported to the toner containing portion 31. In addition to the above-described structure in which excess toner is returned to the toner containing portion 31, excess toner may be discharged from the second transportation portion 34 to another transportation path or another containing portion outside the toner container 30.

By way of example and not limitation, examples of the present disclosure will be given:

EXAMPLES

With examples of the toner container 30, clogging due to toner near the toner discharge port 33 was evaluated. The results are as follows:

The examples and a comparative example were prepared under the specifications and evaluated under the conditions as follows.

Toner Container 30

Comparative Example 1

Figure 9:
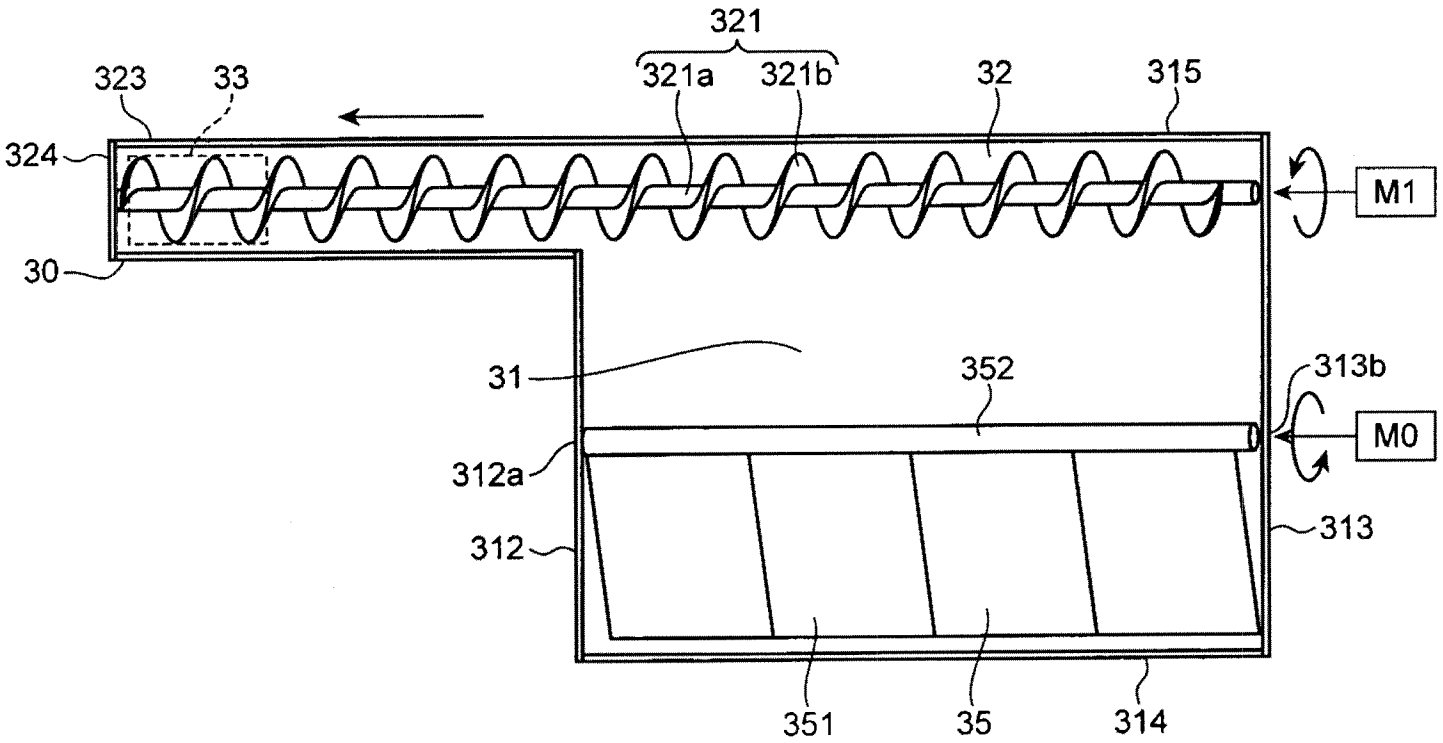
FIG. 9 is a reference drawing of another toner container.

With the first transportation portion 32 (first transportation member 321) only (without the second transportation portion: FIG. 9).

Example 1

With the first transportation portion 32 (first transportation member 321) and the second transportation portion 34 (second transportation member 341). The first transportation member 321 and the second transportation member 341 have the same structure.

Example 2

With the first transportation portion 32 (first transportation member 321) and the second transportation portion 34 (second transportation member 341). The second transportation member 341 is rotated at a number of rotations greater than that of the first transportation member 321.

Example 3

With the first transportation portion 32 (first transportation member 321) and the second transportation portion 34 (second transportation member 343). The pitch of the turns of the blade portion 343*b* of the second transportation member 343 is greater than that of the first transportation member 321.

Example 4

With the first transportation portion 32 (first transportation member 321) and the second transportation portion 34 (second transportation member 341). The second transportation member 341 is rotated at the number of rotations less than that of the first transportation member 321.

Apparatus Conditions

In each of the examples and the comparative example, printing was performed under the same conditions with the image forming apparatus 1 using the developing device 20 that includes the toner container 30.

Printing time (driving time of first transportation member 321): 120 minutes.

Printing condition: 1% coverage rate.

Average toner particle diameter: 6.8 μm.

Clogging due to the toner near the toner discharge port 33 was evaluated under the above-described conditions. Main conditions and results of the evaluation are listed in Table 1. Notations indicate the following results.

A: Clogging due to toner occurred.

B: Clogging due to toner occurred in some occasions.

C: Clogging due to toner did not occur.

TABLE 1

| | first transportation portion | | | second transportation portion | | | |
|---|---|---|---|---|---|---|---|
| | rotation per minute (rpm) | outer diameter (mm) | pitch (mm) | rotation per minute (rpm) | outer diameter (mm) | pitch (mm) | results |
| Example 1 | 15 | 14 | 10 | 15 | 14 | 10 | A |
| Example 2 | 15 | 14 | 10 | 30 | 14 | 10 | A |
| Example 3 | 15 | 14 | 10 | 15 | 14 | 15 | A |
| Example 4 | 15 | 14 | 10 | 7.5 | 14 | 10 | B |
| Comparative example 1 | 15 | 14 | 10 | — | — | — | C |

As described in Table 1, with examples 1 to 4, in which the toner container 30 includes the second transportation portion 34 (second transportation member 341 or 343), desirable results with respect to clogging due to the toner near the toner discharge port 33 were obtained compared to the result with the comparative example 1, in which the toner container 30 does not include the second transportation portion 34. Here, with the example 4, in which the number of rotations at which the second transportation member 341 is rotated was set to be lower than that at which the first transportation member 321 is rotated, the flow of the toner tended to lack smoothness to a small degree near the toner discharge port 33 compared to the other examples. However, since the second transportation portion 34 was provided, the excess toner near the toner discharge port 33 moved toward the second transportation portion 34 side, and accordingly, clogging due to the toner as occurred with the comparative example did not occur.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A developer case comprising:

a main body having a bottom wall, the main body containing developer;

a first transportation portion having a first region and a second region, the first region being located above the bottom wall of the main body in the main body, the first region receiving developer from the main body, the second region extending from the first region so as to project further in a first direction than the main body;

a first transportation member located in the first transportation portion, the first transportation member transporting developer in the first direction;

a supply member located in the main body, the supply member supplying developer to the first region of the first transportation portion;

a discharge port located in the second region of the first transportation portion, developer being discharged through the discharge port; and a second transportation portion having an inlet port communicating with the second region of the first transportation portion, developer not having been discharged through the discharge port being supplied to the second transportation portion through the inlet port, the second transportation portion transporting developer in a second direction, wherein the first transportation portion has a first transportation bottom wall formed of a curved surface having a semi-circular section, the discharge port is formed near a downstream end of the second region in a lower surface of the first transportation bottom wall, and the inlet port is formed by cutting an upper end portion of the first transportation bottom wall and a communication wall having a specific height is formed under the inlet port.

2. The developer case according to claim 1, comprising:

a second transportation member located in the second transportation portion, the second transportation member transporting the developer in the second direction.

3. The developer case according to claim 2, wherein the second transportation portion has an outlet port positioned on a downstream side of the inlet port in a transportation direction of the second transportation member, the outlet port communicating with the first transportation portion.

4. The developer case according to claim 2, wherein the second transportation portion has an outlet port positioned on a downstream side of the inlet port in a transportation direction of the second transportation member, the outlet port communicating with the main body.

5. The developer case according to claim 2, wherein an amount of developer to be transported per unit time by the second transportation member in the second direction is greater than an amount of developer to be transported per unit time by the first transportation member in the first direction.

6. The developer case according to claim 5, comprising:

at least one drive unit that rotates the first transportation member and the second transportation member, wherein the first transportation member and the second transportation member have respective spiral portions, and wherein a pitch of turns of the spiral portion of the second transportation member is greater than a pitch of turns of the spiral portion of the first transportation member.

7. The developer case according to claim 5, comprising:

a first drive unit that rotates the first transportation member; and a second drive unit that rotates the second transportation member, wherein the first transportation member and the second transportation member have respective spiral portions, and wherein a number of rotations per unit time at which the second drive unit rotates the second transportation member is greater than a number of rotations per unit time at which the first drive unit rotates the first transportation member.

8. The developer case according to claim 1, wherein the first transportation member and the second transportation member are located parallel to each other, and wherein the first direction and the second direction are opposite to each other.

9. The developer case according to claim 1, wherein the supply member includes a shaft portion, and a plate member located on the shaft portion, the plate member agitating the developer in the main body, and the plate member transporting the developer to the first region of the first transportation portion.

10. A developer replenishment unit comprising:

a developer case including a main body having a bottom wall, the main body containing developer, a first transportation portion having a first region and a second region, the first region being located above the bottom wall of the main body in the main body, the first region receiving developer from the main body, the second region extending from the first region so as to project further in a first direction than the main body, a first transportation member located in the first transportation portion, the first transportation member transporting developer in the first direction, a supply member located in the main body, the supply member supplying developer to the first region of the first transportation portion, a discharge port located in the second region of the first transportation portion, developer being discharged through the discharge port, and a second transportation portion having an inlet port communicating with the second region of the first transportation portion, developer not having been discharged through the discharge port being supplied to the second transportation portion through the inlet port, the second transportation portion transporting developer in a second direction; and a developing device including a housing, a developer transportation path positioned in the housing, and a receiving port located in the housing, the receiving port positioned at a position opposite the discharge port, the housing being replenished through the receiving port with developer discharged through the discharge port, wherein the first transportation portion has a first transportation bottom wall formed of a curved surface having a semi-circular section, the discharge port is formed near a downstream end of the second region in a lower surface of the first transportation bottom wall, and the inlet port is formed by cutting an upper end portion of the first transportation bottom wall and a communication wall having a specific height is formed under the inlet port.

11. The developer replenishment unit according to claim 10, comprising:

a third transportation member positioned in the housing, the third transportation member transporting developer replenished through the receiving port in a third direction through the developer transportation path, wherein the first direction and the third direction intersect with each other.

12. The developer replenishment unit according to claim 11, wherein the second direction and the third direction intersect with each other.

13. The developer replenishment unit according to claim 12, comprising:

a second transportation member located in the second transportation portion, the second transportation member transporting the developer in the second direction, wherein the first transportation member and the second transportation member are located parallel to each other, and wherein the third transportation member intersects the first transportation member and the second transportation member.

14. The developer replenishment unit according to claim 11, wherein the third transportation member has a transportation capacity reducing portion that reduces an amount of developer to be transported by the third transportation member, the transportation capacity reducing portion causing a developer accumulation portion to be formed at a position opposite the receiving port in the developer transportation path, and wherein the developer transportation path is replenished with developer through the discharge port as an amount of developer in the developer accumulation portion decreases.

15. An image forming apparatus comprising:

a developer case including a main body having a bottom wall, the main body containing developer, a first transportation portion having a first region and a second region, the first region being located above the bottom wall of the main body in the main body, the first region receiving developer from the main body, the second region extending from the first region so as to project further in a first direction than the main body, a first transportation member located in the first transportation portion, the first transportation member transporting the developer in the first direction, a supply member located in the main body, the supply member supplying developer to the first region of the first transportation portion, a discharge port located in the second region of the first transportation portion, developer being discharged through the discharge port, and a second transportation portion having an inlet port communicating with the second region of the first transportation portion, developer not having been discharged through the discharge port being supplied to the second transportation portion through the inlet port, the second transportation portion transporting developer in a second direction;

a developing device including a housing, a developer transportation path provided in the housing, and a receiving port located in the housing, the receiving port positioned at a position opposite the discharge port, the housing being replenished with developer discharged through the discharge port; and an image carrying body on which an electrostatic latent image is formed, the image carrying body carrying a developer image formed by visualizing the electrostatic latent image using the developer, wherein the first transportation portion has a first transportation bottom wall formed of a curved surface having a semi-circular section, the discharge port is formed near a downstream end of the second region in a lower surface of the first transportation bottom wall, and the inlet port is formed by cutting an upper end portion of the first transportation bottom wall and a communication wall having a specific height is formed under the inlet port.

16. The image forming apparatus according to claim 15, wherein the developer case and the developing device are positioned adjacent to each other in a horizontal direction.

* * * * *